United States Patent [19]

Viard

[11] Patent Number: 4,751,822

[45] Date of Patent: Jun. 21, 1988

[54] PROCESS AND PLANT FOR SUPPLYING CARBON DIOXIDE UNDER HIGH PRESSURE

[75] Inventor: Jean-Pierre Viard, Bouxieres-Aux-Dames, France

[73] Assignee: Carboxyque Francaise, Paris, France

[21] Appl. No.: 12,655

[22] Filed: Feb. 9, 1987

[30] Foreign Application Priority Data

Feb. 7, 1986 [FR] France ..... 86 01673

[51] Int. Cl.[4] ..... F17C 7/02

[52] U.S. Cl. ..... 62/55; 62/384

[58] Field of Search ..... 62/55, 384

[56] References Cited

U.S. PATENT DOCUMENTS

| | | | |
|---|---|---|---|
| 2,632,302 | 3/1953 | Steele | 62/55 |
| 2,657,541 | 11/1953 | Schilling | 62/55 |
| 3,053,054 | 9/1962 | Vignier | 62/55 |
| 3,106,071 | 10/1963 | Green et al. | 62/55 |
| 3,112,617 | 12/1963 | Hashemi-Tafreshi | 62/55 |
| 3,282,305 | 11/1966 | Antolak | 141/5 |
| 3,760,599 | 9/1973 | Bose | 62/55 |
| 4,175,395 | 11/1979 | Prost et al. | 62/55 |
| 4,554,791 | 11/1985 | Johansson | 62/55 |

FOREIGN PATENT DOCUMENTS

| | | |
|---|---|---|
| 449412 | 3/1943 | Belgium . |
| 8300239 | 1/1986 | Fed. Rep. of Germany . |

*Primary Examiner*—Ronald C. Capossela

*Attorney, Agent, or Firm*—Young & Thompson

[57] ABSTRACT

A process and apparatus for bringing $CO_2$ from a storage tank wherein it is stored at a medium pressure and below 0° C. (e.g. −20° C. and 20 bars pressure) to a high pressure such as 80–130 bars, without utilizing any pump operating below 0° C. The build-up of ice on such a pump is thus avoided. To do this, liquid from the tank is caused to completely fill by gravity an intermediate vessel. Then the vessel is heated to about ambient temperature; and while maintaining such temperature (e.g. by means of resistor 16), the liquid in the vessel is subcooled by compression in FIG. 1 or by cooling water in FIG. 2, and conveyed to the inlet of the high pressure pump.

14 Claims, 2 Drawing Sheets

PROCESS AND PLANT FOR SUPPLYING CARBON DIOXIDE UNDER HIGH PRESSURE

The present invention relates to a process for supplying carbon dioxide under high pressure by means of a high pressure pump, from a tank storing liquid carbon dioxide at a temperature lower than ambient temperature. It is for example applicable to the supply of $CO_2$ under a pressure on the order of 80 to 130 bars.

A conventional technique for obtaining $CO_2$ under high pressure comprises pumping the liquid $CO_2$ in two stages: a supply pump withdraws the liquid, usually stored at −20° C. and 20 bars absolute, and brings it to an intermediate pressure which is the inlet pressure of the high pressure pump. Consequently, the supply pump operates in the cold state under severe conditions and is covered with ice, which renders interventions on this pump awkward.

An object of the invention is to provide a simple and reliable technique which overcomes this drawback. It therefore provides a process of the aforementioned type comprising:

completely filling an intermediate vessel with liquid carbon dioxide coming from the storage tank, this filling being achieved merely under the effect of gravity;

bringing the contents of the intermediate vessel to a temperature about ambient temperature, and while maintaining the intermediate vessel at the same temperature, withdrawing the liquid from this intermediate vessel, subcooling it and conveying it to the inlet of the pump.

According to advantageous features of the invention it comprises:

before withdrawing the liquid from the intermediate vessel, putting this vessel in communication with an auxiliary source of gaseous carbon dioxide at the liquid-vapour equilibrium pressure of the carbon dioxide at said temperature;

using as an auxiliary source of gaseous carbon dioxide a cylinder containing liquid carbon dioxide maintained at said temperature;

permanently regulating the delivery of the high pressure pump by comparing its delivery pressure with a set pressure and modifying the delivery of the pump in the sense which tends to eliminate the difference between these two pressures.

Another object of the invention is to provide a plant for carrying out such a process. This plant is of the type comprising a tank for storing liquid carbon dioxide at a temperature lower than ambient temperature, a high pressure pump, and means for supplying said pump with liquid carbon dioxide from the tank, said plant further comprising:

an intermediate vessel entirely located below the minimum level of the liquid in the tank and connected to the lower and upper parts of said tank;

means for heating said intermediate vessel regulated to a temperature about ambient temperature; and a conduit connecting the intermediate vessel to the inlet of the pump and provided with means for subcooling the liquid it conveys.

Embodiments of the invention will now be described with reference to the accompanying drawings, in which.

Figure 1:
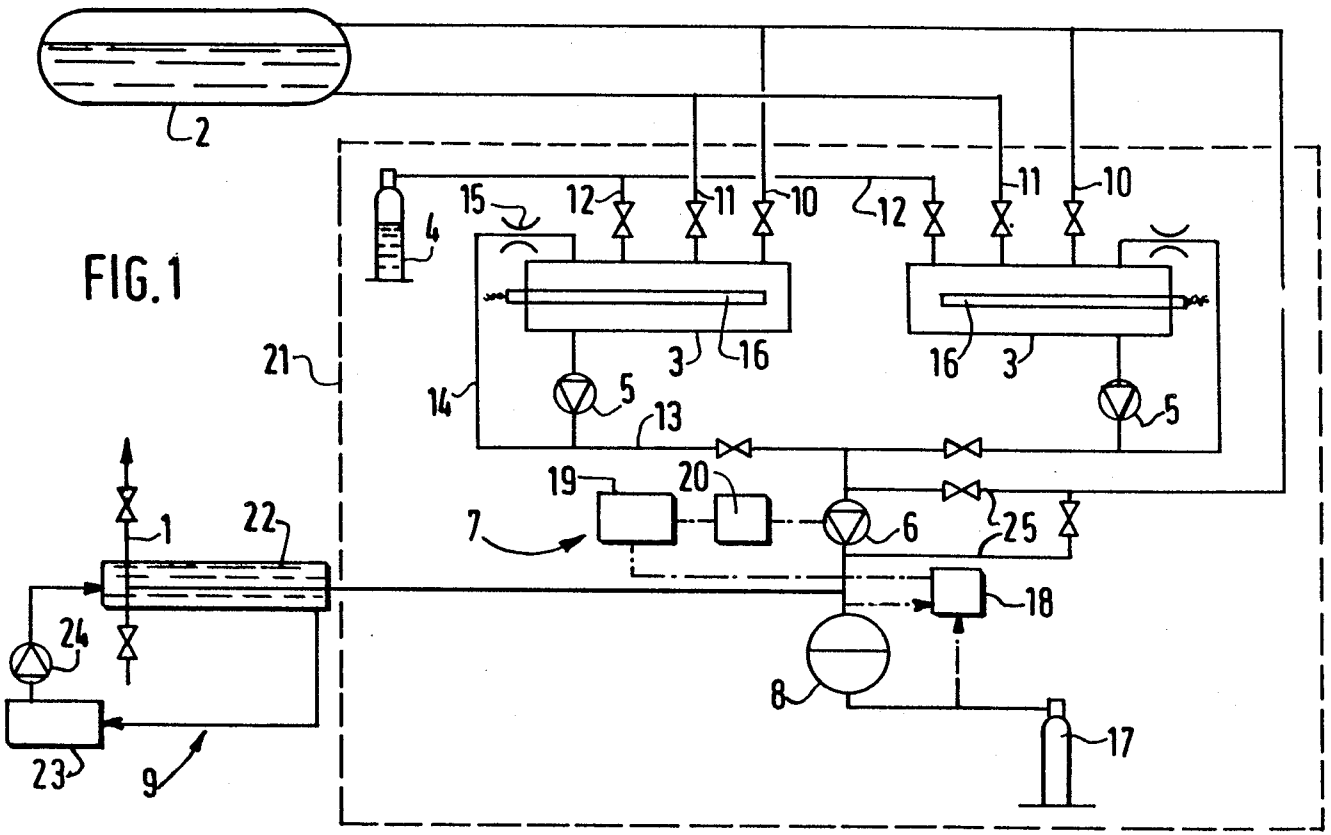
FIG. 1 is a diagrammatic view of a plant according to the invention.

The plant shown in FIG. 1 is adapted to supply through a utilisation conduit 1 liquid $CO_2$ under a regulated high pressure which is for example on the order of 80 to 130 bars at about ambient temperature. It mainly comprises a large-capacity tank 2 for storing liquid $CO_2$ at −20° C. and 20 bars absolute, two intermediate vessels 3 of much smaller capacity, for example on the order of 100 liters, a cylinder 4 containing liquid $CO_2$, two centrifugal supply pumps 5 respectively associated with the vessels 3, a high pressure pump 6 of the volumetrc membrane type provided with a regulation device 7, an accumulator 8 and a device 9 for subcooling the high pressure liquid.

The vessels 3 are disposed entirely at a level lower than the minimum level of the liquid in the tank 2, in practice entirely below the bottom of said tank. The upper part of the tank is connected in parallel with the two vessels 3 through conduits 10, and the lower part of the tank is connected in parallel with said two vessels through conduits 11. The cylinder 4 is also connected in parallel with the two vessels 3 through conduits 12.

The inlet of the pump 6 is connected in parallel with the two vessels 3 through conduits 13 each provided with a supply pump 5. A conduit 14 provided with a restriction (or, by way of a modification, a calibrated valve) 15 connects the discharge of each pump 5 to the associated vessel 3.

Each vessel 3 is provided internally with a heating resistor 16 adapted to maintain the contents of the vessel at a constant temperature which is about ambient temperature, for example +20° C.

The accumulator 8 is divided into two chambers by a membrane; one of these chambers is connected to a cylinder 17 containing an auxiliary gas, for example nitrogen, at the desired high pressure (set pressure), and the other chamber is connected to the discharge of the pump 6. The utilisation conduit 1 leads from the inlet of the last-mentioned chamber.

The regulation device 7 comprises a differential pressure sensor 18 which measures the set pressure and the delivery pressure of the pump 6. It sends to a frequency converter 19 a signal representing the difference between these two pressures and the frequency converter regulates, as a function of said signal, the speed of a motor-speed reducer unit 20 driving the pump 6 and/or the travel of its piston, by increasing or decreasing it, depending on whether the delivery pressure is lower or higher than the set pressure.

The vessels 3, the cylinders 4 and 17, the pumps 5 and 6, and the accumulator 8 are disposed in a premises 21 whose temperature is permanently maintained at the aforementioned value of +20° C. When it leaves said premises, the conduit is cooled a few degrees, for example to +10° to +15° C., by the device 9. Said device comprises a jacket 22 surrounding the conduit 1, a water conditioner 23, and a circulation circuit comprising a pump 24 and adapted to circulate the water countercurrent to the $CO_2$ in the jacket 22.

Further, the upper part of the tank 2 is connected to the inlet and outlet of the pump 6 by conduits 25, and the conduits 1, 10 to 13 and 25 are provided with electrically-operated valves for the operation of the plant which will now be described.

Initially, all the circuits are purged with gaseous CO at −20° C. and 20 bars by means of the conduits 10, 13, 14 and 25, then, with the electrically-operated valves of the conduits 10 remaining open and those of the conduits 12, 13 and 25 closed, the electrically-operated valves of the conduits 11 are opened. Thus, by the mere effect of gravity, the vessels 3 are completely filled with liquid, the pumps 5 are flooded and the liquid rises up to a level higher than that of the electrically-operated valves of the conduits 10 and 11.

After the closure of these four electrically-operated valves, the resistors 16 are supplied with current and the liquid contained in the vessels 3 is brought to +20° C., with a corresponding increase in pressure but with no vapour pressure.

The electrically-operated valves of the conduits 12 are then opened and this puts the liquid contained in the two vessels 3 in equilibrium with its vapour at +20° C. and 58 bars absolute, and the pumps 5 are started up. As the valves of the conduits 13 are closed, there is created in the latter, owing to the presence of the restrictions 15, a higher pressure, for example on the order of 70 bars. The liquid $CO_2$ is therefore subcooled, which ensures a monophase supply of the high pressure pump 6.

The electrically-operated valve of one of the conduits 13 is then opened and the high pressure pump 6 is started up. This delivers liquid $CO_2$ under high pressure to the accumulator 8 and to the conduit 1 which is purged by the gaseous $CO_2$ contained therein, and the pressure increases in the conduit 1 to the desired value. The valve closing said conduit 1 can then be opened and the liquid $CO_2$ used. Said liquid, during its flow through the conduit 1, is subcooled by the device 9 as it leaves the premises 21, which initially ensures the recondensation of the gaseous $CO_2$ which may exist in the conduit 1, then a monophase liquid distribution.

As soon as there is a consumption of high pressure $CO_2$, the level of the liquid drops in the vessel 3 in use. In the latter, the liquid, which is constantly heated to +20° C., is vaporized so that the pressure is maintained at 58 bars without consumption of the $CO_2$ contained in the cylinder 4.

The high pressure is maintained at a constant value by the regulation of the delivery of the pump 6 by means of the device 7, in the manner described hereinbefore. Further, owing to the presence of the accumulator 8, the pulsations of the pump 6 are not felt in the conduit 1.

When the vessel 3 in use is almost empty (which may be determined by a timing device when the plant operates continuously), the electrically-operated valves of the conduit 13 are commutated, which puts the other vessel 3 in use and stops the pump 5 of the first vessel 3, and the other vessel is filled by gravity with liquid $CO_2$ from the tank 2, as before, after equilibrium of the pressures through the associated conduit 10.

Figure 2:
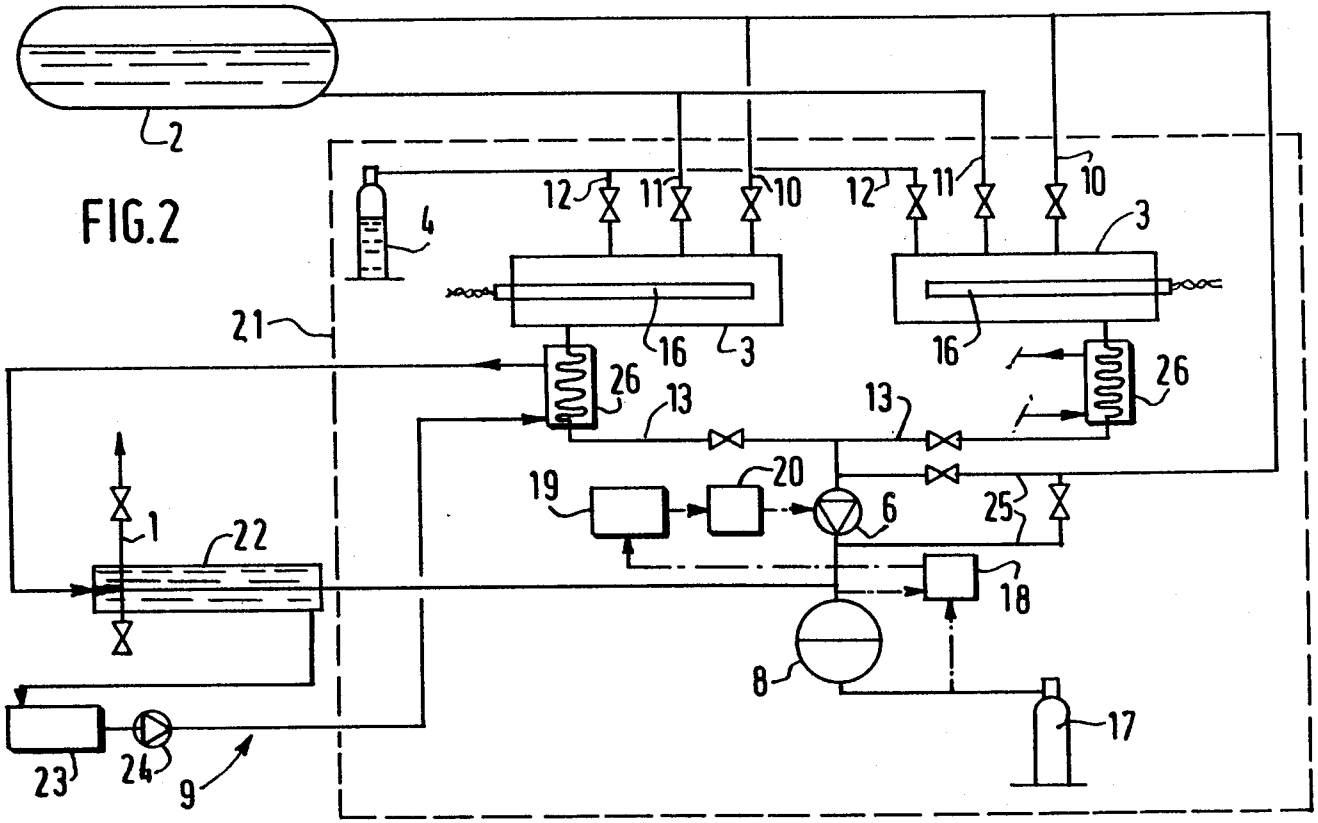
FIG. 2 is a similar view of a modification of said plant.

The plant shown in FIG. 2 differs from that of FIG. 1 only in the manner in which the liquid is subcooled as it leaves the vessels 3. Indeed, in this case, instead of increasing its pressure at constant temperature, its temperature is reduced at constant pressure. For this purpose, the pumps 5, the return conduits 14 and their restrictions 15 are eliminated and each conduit 13 extends through a heat exchanger 26 cooled in a countercurrent manner by water supplied by the device 9 and connected in series with the jacket 22 upstream of the latter.

Note that all or a part of the liquid $CO_2$ contained in the conduit 1 may be optionally vaporized for use in the gaseous state.

What is claimed is:

1. A process for supplying carbon dioxide under a high pressure which is above the liquid-vapor equilibrium pressure of carbon dioxide at ambient temperature, by means of a high pressure pump from a tank storing liquid carbon dioxide under a medium pressure and at a first temperature lower than 0° C., the process comprising:

completely filling an intermediate vessel with liquid carbon dioxide from the storage tank, said filling being achieved merely under the effect of gravity;

isolating said intermediate vessel from said tank;

bringing the liquid in the intermediate vessel to a second temperature which is about ambient temperature; and while maintaining the intermediate vessel at said second temperature: withdrawing liquid from said intermediate vessel; subcooling the withdrawn liquid while maintaining it above 0° C.; and conveying the subcooled liquid to the inlet of the pump.

2. A process according to claim 1, comprising putting, before withdrawing the liquid from the intermediate vessel, said vessel in communication with an auxiliary source of gaseous carbon dioxide at a liquid-vapour equilibrium pressure of the carbon dioxide at said second temperature.

3. A process according to claim 2, comprising employing as the auxiliary source of gaseous carbon dioxide a cylinder containing liquid carbon dioxide and maintained at said second temperature.

4. A process according to claim 1, comprising continuously regulating the output of the high pressure pump by comparing the delivery pressure thereof with a set pressure and modifying the output of the pump in the sense which tends to eliminate the difference between said delivery and set pressures.

5. A process according to claim 1, comprising subcooling the withdrawn liquid by increasing its pressure by means of an auxiliary pump.

6. A process according to claim 1, comprising using a cooling fluid maintained at a temperature lower than said second temperature for subcooling the liquid withdrawn from the intermediate vessel and subcooling the liquid delivered by the high pressure pump.

7. A process according to claim 6, wherein said cooling fluid is water.

8. A process according to claim 1, comprising employing two said intermediate vessels, one said vessel being filled while liquid is being withdrawn from the other vessel.

9. A plant for supplying carbon dioxide under a high pressure which is above the liquid-vapor equilibrium pressure of carbon dioxide at ambient temperature, the plant comprising a tank for storing liquid carbon dioxide under a medium pressure and at a first temperature lower than 0° C., a high pressure pump having an inlet and a discharge outlet, and means for supplying liquid carbon dioxide to said pump from the tank, said plant further comprising:

an intermediate vessel entirely located below a minimum level of the liquid in the tank and connected to lower and upper parts of said tank;

means for heating said intermediate vessel, and means for regulating said heating means at a second temperature which is about ambient temperature; and a conduit connecting the intermediate vessel to the inlet of the pump and provided with means for subcooling the liquid conveyed in said conduit while maintaining it above 0° C.

10. A plant according to claim 9, comprising an auxiliary source of gaseous carbon dioxide under a liquid-vapour equilibrium pressure of the carbon dioxide at said second temperature, connected to the intermediate vessel.

11. A plant according to claim 9, comprising a source of auxiliary gas under said high pressure, a differential pressure sensor measuring the difference between the pressure of said gas and the pressure of the liquid delivered by the high pressure pump, and a frequency converter receiving from said sensor a signal representing the difference between the two pressures and regulating the output of the pump as a function of said signal.

12. A plant according to claim 11, wherein the subcooling means comprise an auxiliary pump in said conduit.

13. A plant according to claim 9, comprising a water circuit maintained at a temperature lower than said second temperature, in thermal exchange relation to the liquid withdrawn from the intermediate vessel and to a conduit delivering liquid carbon dioxide under high pressure.

14. A plant according to claim 9, comprising two said intermediate vessels operating alternately and interposed in parallel between the storage tank and the high pressure pump whereby, in use, one said vessel is filled while liquid is being withdrawn from the other vessel.

* * * * *